US010508374B2

(12) United States Patent
Pesavento et al.

(10) Patent No.: US 10,508,374 B2
(45) Date of Patent: Dec. 17, 2019

(54) METHOD FOR OPERATING A LAUNDRY WASHING APPLIANCE AND LAUNDRY WASHING APPLIANCE IMPLEMENTING THE SAME

(71) Applicant: Electrolux Appliances Aktiebolag, Stockholm (SE)

(72) Inventors: Elena Pesavento, Porcia (IT); Elisa Stabon, Gorizia (IT); Andrea Zattin, Solesino (IT)

(73) Assignee: Electrolux Appliances Aktiebolag (SE)

( * ) Notice: Subject to any disclaimer, the term of this patent is extended or adjusted under 35 U.S.C. 154(b) by 223 days.

(21) Appl. No.: 15/320,705

(22) PCT Filed: Jun. 24, 2014

(86) PCT No.: PCT/EP2014/063215
§ 371 (c)(1),
(2) Date: Dec. 20, 2016

(87) PCT Pub. No.: WO2015/197106
PCT Pub. Date: Dec. 30, 2015

(65) Prior Publication Data

US 2017/0152620 A1 Jun. 1, 2017

(51) Int. Cl.
*D06F 33/02* (2006.01)
*D06F 39/08* (2006.01)
(Continued)

(52) U.S. Cl.
CPC ..... *D06F 33/02* (2013.01); *D06F 35/006* (2013.01); *D06F 39/004* (2013.01);
(Continued)

(58) Field of Classification Search
CPC ..... D06F 39/004; D06F 33/02; D06F 39/083; D06F 39/04; D06F 39/005; D06F 35/006;
(Continued)

(56) References Cited

U.S. PATENT DOCUMENTS 5,134,867 A 8/1992 Kiuchi et al.
5,253,379 A * 10/1993 Dusamos ..... D06F 39/004 137/5
(Continued)

FOREIGN PATENT DOCUMENTS

DE 19534431 A1 3/1997
DE 10145601 A1 10/2002
(Continued)

OTHER PUBLICATIONS

Machine Translation of DE 102012208618 to Eglmeier et al., Nov. 2013. (Year: 2013).*
(Continued)

*Primary Examiner* — Benjamin L Osterhout
(74) *Attorney, Agent, or Firm* — RatnerPrestia

(57) ABSTRACT

A method (100) for operating a laundry washing appliance (10), such as a washing machine or a combined washer-dryer, having a washing chamber (12) to wash goods according to a wash program selected by a user including at least a washing cycle. The method includes adding (110) a detergent to a washing liquor (15) within the washing chamber (12) during a washing phase of the washing cycle, the washing phase having a predefined duration; performing (130) a plurality of measurements of the conductivity of the washing liquor (15) in order to collect a set of conductivity measurements ($C_1, \ldots, C_n$) defining a conductivity curve analyzing the set of conductivity measurements ($C_1, \ldots, C_n$) in order to determine (150) if a condition of substantial invariability of the conductivity measurements ($C_1, \ldots, C_n$) is reached and/or detect (140) if the related conductivity curve shows a peak. The method also includes extending (160) the predefined duration of the washing phase, if after a first preset time period ($T_{ref}$) starting from the beginning of the washing phase, no conductivity increase or peak in the conductivity curve is detected; and/or extending (160) the
(Continued)

predefined duration of the washing phase, if after a second preset time period ($T_{ref}$) starting from the beginning of the washing phase, the condition of substantial invariability of the conductivity measurements ($C_1, \ldots, C_n$) has not been reached.

20 Claims, 2 Drawing Sheets

(51) Int. Cl.
*D06F 39/04* (2006.01)
*D06F 39/00* (2006.01)
*D06F 35/00* (2006.01)

(52) U.S. Cl.
CPC ..... *D06F 39/005* (2013.01); *D06F 39/04* (2013.01); *D06F 39/083* (2013.01); *D06F 2202/02* (2013.01); *D06F 2204/04* (2013.01); *D06F 2212/02* (2013.01); *D06F 2220/00* (2013.01)

(58) Field of Classification Search
CPC ..... D06F 2202/02; D06F 2212/02; D06F 2220/00; D06F 2204/04
See application file for complete search history.

(56) References Cited

U.S. PATENT DOCUMENTS

| | | | | |
|---|---|---|---|---|
| 5,731,868 | A * | 3/1998 | Okey | A47L 15/4297 356/442 |
| 6,718,991 | B1 * | 4/2004 | Breyer | A47L 15/44 134/25.2 |
| 2002/0117187 | A1 * | 8/2002 | Helminger | A47L 15/0055 134/18 |
| 2006/0216217 | A1 * | 9/2006 | Chan | A47L 15/4297 422/218 |
| 2008/0017221 | A1 * | 1/2008 | Fife | D06F 33/02 134/18 |
| 2008/0249234 | A1 * | 10/2008 | Ebert | C08G 63/695 524/539 |
| 2010/0095465 | A1 | 4/2010 | Kim et al. | |
| 2013/0145563 | A1 * | 6/2013 | Kang | D06F 39/004 8/137 |

FOREIGN PATENT DOCUMENTS

| | | | |
|---|---|---|---|
| DE | 102012208618 | A1 | 11/2013 |
| EP | 0393311 | A1 | 10/1990 |
| EP | 1688529 | A1 | 8/2006 |
| EP | 1707663 | A1 | 10/2006 |
| EP | 2113599 | A1 | 11/2009 |
| EP | 2183423 | A1 | 5/2010 |
| EP | 2243416 | A1 | 10/2010 |
| JP | H07124374 | A | 5/1995 |
| JP | H08112484 | A | 5/1996 |
| JP | 2011200524 | A | 10/2011 |
| JP | 2014064791 | A | 4/2014 |

OTHER PUBLICATIONS

International Search Report in corresponding International Application No. PCT/EP2014/063215, dated Mar. 6, 2015.
International Search Report in corresponding International Application No. PCT/EP2014/063239, dated Feb. 25, 2015.
International Search Report in corresponding International Application No. PCT/EP2014/063237, dated Mar. 12, 2015.
Database WPI, Week 201169, Thomson Scientific, London, GB; AN 2011-M70965, XP002736410, =& JP 2011 200525 A (Matsushita Denki Sangyo KK), Oct. 13, 2011, abstract, paragraphs [0015], [0039]-[0071]; figures.

* cited by examiner

METHOD FOR OPERATING A LAUNDRY WASHING APPLIANCE AND LAUNDRY WASHING APPLIANCE IMPLEMENTING THE SAME

FIELD

The present invention is relative to a method for operating a laundry washing appliance, such as a washing machine or a combined washer-dryer, apt to wash laundry in one or more washing cycles, and to a laundry washing appliance implementing the same.

BACKGROUND

A washing cycle of laundry as performed by a laundry washing appliance generally comprises two phases: a washing phase and a rinse phase.

A wash program o process comprises one or more washing cycles and is possibly terminated by a final spinning phase. Additional spinning steps might be present between consecutive rinsing steps during the rinsing phase.

The washing phase represents the portion of each washing cycle during which water is supplied into the appliance possibly together with the detergent to form a washing liquor (wetting step), the washing liquor is possibly heated (heating step), the laundry to be washed is subjected to tumbling of the drum in order to repeatedly expose it to mechanical action and to the washing liquor, so that dirt is removed from the laundry and stabilized in the washing liquor (tumbling step) and finally the washing liquor in which dirt is stabilized, is drained from the washing chamber (draining step).

The key parameters involved in each washing phase are: temperature, amount of water, mechanical action, detergent type/amount and duration. In order to provide best results in washing performances vs. water and energy consumption, one or more of these parameters are generally optimized.

The rinsing phase aims to remove the residuals of dirt and detergent coming from the washing phase. In many appliances, the rinsing phase is performed stepwise, e.g. generally two or three rinsing steps are performed. Each step is commonly characterized by a defined amount of water, duration, and mechanical action.

In current laundry washing appliances, the duration of each washing phase and the timing between its subsequent phases or steps are preset by the selection of a washing program and other possible parameters without taking into account the effective water and/or laundry conditions. In other words, each next phase or step starts independent of the completion degree of the previous one. By way of an example, each washing phase of a wash program has usually a predefined duration which is fixed and dependent on the specific wash program chosen by the user.

The expression "predefined duration of a washing phase" is used to identify the duration preset by the choice of a specific wash program.

Applicant has realized that the effectiveness of the washing phase depends on the time that the laundry is exposed to the fully dissolved detergent into the washing liquor at the most appropriate temperature.

Furthermore, Applicant has noted that the time required to reach a full dissolution condition varies from detergent type to detergent type.

Many types of detergents to be used in laundry washing appliances are available nowadays.

The detergents can be classified into different kinds, depending on their physical state: there are detergents in powder form and detergents in liquid or gel form. Furthermore, the above detergent kinds can be found on the marked in conventional form or pre-dosed.

Throughout the present description, the expression "detergent in conventional form" is used to refer to a detergent which can be poured or introduced loose into the washing machine drawer in a quantity which can be freely decided by the user. Throughout the present description, the expression "pre-dosed detergent" is used to refer to a detergent which the user introduces directly into the drum in a pre-established quantity. The pre-dosed detergent can be in liquid, gel or powder form (the latter possibly pressed).

Pre-dosed detergents—especially pre-dosed detergents in liquid or gel form, but in some cases, also pre-dosed detergents in powder form—are conventionally encapsulated, namely enveloped in a plastic membrane which dissolves in water. Applicant has noticed that encapsulated detergents require a longer time before a condition of full dissolution into water is reached, compared to the other detergent types since the plastic membrane has to dissolve first, before dissolution of the detergent in water can start.

Moreover, the real dissolution time depends also on the specific loading conditions which could affect the exposure of the plastic membrane to water. By way of an example, the encapsulated detergent should be preferably placed on the bottom of the drum, before the laundry is loaded.

If the user does not follow the above loading sequence, the dissolution of the plastic membrane could take longer than expected so that the detergent would reach its dissolved state only towards the end of the washing phase.

This could lead to a reduced washing effectiveness since less time would be available for the dissolved detergent to act on the laundry during the washing phase.

This problem could arise also if the correct loading sequence is followed by the user. In fact, it could happen that the movement of the laundry inside of the drum pushes the encapsulated detergent towards the top of the laundry or the door gasket. In these positions, the encapsulated detergent does not get in contact with enough water in order to undergo a rapid dissolution.

The above considered, Applicant has realized that, a deeper correlation between the duration of the washing phase and the water and/or laundry conditions could lead to performance improvements and has focused its attention to the lack of coordination between detergent dissolution and the duration of the washing phase in current washing appliances.

Applicant has considered that setting a very long washing phase duration corresponding to the feasible longest detergent dissolution would imply, in most cases, an unnecessary extension of the overall wash program duration which could make the user believe that a deficiency is present in the washing apparatus itself, which is, in his/her opinion, not performing properly.

Applicant has thus understood that a modification in the laundry washing appliance has to be made in order to establish a tuning between detergent dissolution and the washing phase so as to link the duration of the washing phase to the real dissolution level of the detergent, thereby optimizing the washing performances while keeping short the overall washing cycle duration.

SUMMARY OF SELECTED INVENTIVE ASPECTS

A first aspect of the present invention therefore relates to a method for operating a laundry washing appliance.

In detail, an aspect of the invention provides for a method for operating a laundry washing appliance comprising a washing chamber to wash goods according to a wash program selected by a user including at least a washing cycle, the method including:

Adding a detergent to a washing liquor within the washing chamber during a washing phase of a washing cycle, the washing phase having a predefined duration;

Performing a plurality of measurements of the conductivity of the washing liquor in order to collect a set of conductivity measurements defining a conductivity curve;

Analyzing the set of conductivity measurements in order to determine if a condition of substantial invariability of the conductivity measurements is reached and/or detect if the related conductivity curve shows a peak;

Extending the predefined duration of the washing phase, if after a first preset time period starting from the beginning of the washing phase, no conductivity increase or peak in the conductivity curve is detected; and/or Extending the predefined duration of the washing phase, if after a second preset time period starting from the beginning of the washing phase, the condition of substantial invariability of the conductivity measurements has not been reached.

The present invention is applicable to laundry washing appliances, such as for example a washing machine as well as a combined washer-dryer, apt to wash laundry in one or more washing cycles.

The laundry washing appliance generally includes a washing chamber where the laundry to be washed is loaded and then removed, after the wash program has finished.

In the washing chamber, water and detergent are introduced at the beginning of the washing phase of each washing cycle of the wash program selected by the user, in order to form the washing liquor which is used to wash the laundry loaded into the washing chamber.

In the present description and in the following claims, with "washing cycle" it is meant the portion of a washing program comprising a washing phase, a rinse phase and possibly a spinning step.

The term "washing cycle" it is meant the portion of a washing program comprising a washing phase, a rinse phase and possibly a spinning step.

The term "washing phase" it is meant the portion of each washing cycle during which water is supplied into the appliance possibly together with the detergent to form a washing liquor (wetting step), the washing liquor is possibly heated (heating step), the laundry to be washed is subjected to tumbling of the drum (tumbling step) and finally the washing liquor is drained from the washing chamber (draining step).

The term "the beginning of the washing phase" it is meant the moment when the water inlet is opened for the first time during a washing cycle and fresh water is introduced into the washing chamber.

The term "predefined duration of the washing phase" it is meant the amount of time which the appliance calculates for the washing phase—and particularly the tumbling step of the washing phase—to last, based on the initial selections performed by the user and preferably by the amount of laundry loaded in the drum.

In fact, on the control panel of the machine, the user selects a wash program and possibly additional parameters such dirty level, temperature and so on, which have an influence on the calculation of the washing phase duration performed by the appliance.

As said above, encapsulated detergent can experience a dissolution delay due to the fact that the plastic membrane enveloping the detergent needs to at least partially dissolve before the detergent undergoes solution. This could lead to a reduced washing effectiveness since less time would be available for the dissolved detergent to act on the laundry during the washing phase.

In order to solve this problem, Applicant has had the idea of identifying if an encapsulated detergent is used and, in the affirmative, extending the washing phase in order to give to the lately dissolved detergent sufficient time to act on the load.

Applicant has considered that there is a correlation between detergent concentration and conductivity of water. Thus, an analysis of the washing liquor conductivity, leads to information on the detergent concentration and thus on the detergent dissolution degree into the washing liquor.

Applicant has also considered that through the measurement of the washing liquor conductivity and an appropriate analysis of the related curve, it is possible to determine if an encapsulated detergent has been used.

In detail, Applicant has noticed that, when adding encapsulated detergent to the washing liquor, its conductivity grows slowly as detergent dissolves into the same, and struggles to reach a steady condition ("plateau"), namely a condition in which the conductivity value substantially does not vary anymore. Applicant has also recognized that reaching of the above substantially steady condition identifies a substantially complete dissolution of detergent into the washing liquor.

Applicant has also noticed that, if detergent is added to the washing liquor loose, its conductivity experiences a sudden and very high increase (peak) due to the fact that the detergent is flushed from the drawer in the very beginning of each washing phase when water introduction has not been completed yet.

Thus, according to an aspect of the invention, a plurality of measurements of the conductivity of the washing liquor is performed and the measured conductivity values are analysed in order to detect if a sudden and very high increase of the same (peak) is experienced by the corresponding conductivity curve within a first preset time period and, alternatively or in addition, if the steadiness condition is reached within a second preset time period.

Thus, according to the invention a plurality of measurements of the conductivity of the washing liquor is performed and the measured conductivity values are analysed in order to detect if a sudden and very high increase of the same (peak) is experienced by the corresponding conductivity curve within a first preset time period and, alternatively or in addition, if the steadiness condition is reached within a second preset time period.

In case, after the first preset time period, no such a peak or increase is detected and/or, after the second preset time period, the steadiness condition has still not been reached, it is understood that an encapsulated detergent has been used. Accordingly, as already explained above, the washing phase is extended in order, for the lately dissolved detergent, to have enough time to act on the load.

The first and second preset time periods derive from experimental data and are preferably chosen so as to balance the sensitivity degree and the reaction speed of the operating method. In fact, the longer the analysis phase lasts, the more precise the detection is. On the other hand, the shorter the analysis phase is, the quicker the appliance defines the real duration of the washing phase.

Not least, Applicant considered that, in case a washing appliance already comprised a conductivity sensor, said washing appliances could be easily modified in order to implement the method for operating a laundry washing appliance according to the invention.

The invention, according to the above described aspect, may include, alternatively or in combination, one of the following features.

Preferably, the predefined duration of the washing phase is extended by a first fixed extension time.

Advantageously, the extension of the washing phase of a preset amount of time is quiet easy to implement since no dynamic calculation of the extension time has to be performed. Thus, the washing phase duration can be extended without the need of further calculations.

Preferably, the predefined duration of the washing phase is extended by an extension time dependent on a time required to reach the condition of substantial invariability of the conductivity measurements.

Advantageously, in this way the predefined duration of the washing phase is extended by an amount of time dependent on the real dissolution degree of the detergent in the washing liquor.

More preferably, if the amount of time required to reach the condition of substantial invariability of the conductivity measurements is lower than a fixed time value, the predefined duration of the washing phase is extended by an extension time equal to zero; and if the amount of time required to reach the condition of substantial invariability of the conductivity measurements is greater than or equal to a fixed time value, the predefined duration of the washing phase is extended by an extension time equal to the difference between the time for reaching the of substantial invariability of the conductivity measurements and the fixed time value. Even more preferably, the fixed time value is variable dependent on the wash program selected by the user.

This specific calculation expediently avoids introducing an extension of time where it is actually not required, namely when the amount of time required to reach the condition of detergent full dissolution is lower than a fixed but wash-program-dependent time value which denotes a sufficiently rapid dissolution according to the selected wash program.

Preferably, the first preset time period is less than or equal to the second preset time period.

By way of a preferred example in which the detergent introduction into the washing chamber substantially coincides in time with the start of the washing phase, the first preset time period is comprised between 30 sec and 5 min, preferably between 30 sec and 3 min and more preferably between 30 sec and 1 min.

According to this preferred example, the second preset time period is comprised between 3 min and 20 min, preferably between 5 min and 18 min and more preferably between 10 min and 15 min.

Applicant has identified that, typically, in appliances in which the wetting of the load is made with water and detergent, the conductivity curve related to loose detergent experiences a sudden and very high increase (peak) in a time ranging from 30 sec to 3 min and reaches the steadiness condition in a time ranging from 3 to 20 min. Thus, the first and second preset time periods are advantageously chosen to be within the above ranges.

By way of a further example in which the detergent introduction into the washing chamber is slightly delayed with respect to the start of the washing phase, the first preset time period is comprised between 30 sec and 10 min, preferably between 30 sec and 8 min and more preferably between 30 sec and 5 min.

According to this further example, the second preset time period is comprised between 3 min and 30 min, preferably between 5 min and 20 min and more preferably between 10 min and 15 min.

Applicant has identified that, typically, in appliances in which the wetting of the load is made just with water and the detergent is introduced into the washing chamber only after the wetting of the load has taken place, the conductivity curve related to loose detergent experiences a sudden and very high increase (peak) in a time ranging from 30 sec to 10 min and reaches the steadiness condition in a time ranging from 3 to 30 min.

Thus, the first and second preset time periods are advantageously chosen to be within the above ranges.

Preferably, the method further comprises determining the amount of time required to get to said condition of substantial invariability of the conductivity measurements. More preferably, the step of determining the amount of time required to get to the condition of substantial invariability of the conductivity measurements comprises carrying on with performing a plurality of measurements of the conductivity of the washing liquor and analyzing the set of conductivity measurements in order to determine if a condition of substantial invariability of the conductivity measurements has been reached, until said condition of substantial invariability of the conductivity measurements is reached.

Even if after the second preset time period the steadiness condition has still not been reached, the method expediently provides for carrying on with the measurements and the analysis in order to determine the point in time in which the steadiness condition is reached. This piece of information can be advantageously used to several purposes, e.g. for the calculation of a precise time extension of the predefined washing phase duration or for the heater ignition.

Preferably, the step of analyzing the set of conductivity measurements in order to determine if a condition of substantial invariability of the conductivity measurements is reached comprises:

comparing relative variations of successive conductivity measurements according to the formula:

$$\sum_{k=0}^{m} |c_{n-k} - c_{n-k-1}| < [\text{Threshold} > 0]$$

identifying a condition of substantial invariability of the conductivity measurements when the sum of the relative variations keeps staying below a threshold.

More preferably, the number of successive conductivity measurements to be taken into consideration for the evaluation of the condition of substantial invariability is equal to or greater than two.

This particular way of analyzing the conductivity measurements leads to an accurate detection of the steadiness condition with lower possibility to fail. In fact, this formula assures that the conductivity variations are considered over a longer time thereby taking into account both signal noise and variance and excluding accidental fulfillment of the condition set.

Preferably, the step of determining the amount of time required to get to a condition of substantial invariability of the conductivity measurements further includes measuring the amount of time passed from the start of the washing phase to the point of time the condition of substantial invariability of the conductivity measurements has been reached.

Preferably, the step of determining the amount of time required to get to a condition of substantial invariability of the conductivity measurements is repeated until either the condition of substantial invariability is reached or an upper time limit has been exceeded.

More preferably, if the condition of substantial invariability is not reached after the upper time limit has expired, the predefined duration of the washing phase is extended by a second fixed extension time.

This advantageously avoids the calculation to last excessively in case the signal steadiness detection fails, while still assuring that the washing phase predefined duration is extended.

Preferably, extending the predefined duration of the washing phase comprises extending the duration of a tumbling step of the washing phase.

Preferably, the detection if the conductivity curve shows a peak includes comparing relative variations of successive conductivity measurements according to the formula:

$$\sum_{k=0}^{n} |c_{i-k} - c_{i-k-1}| > [\text{Threshold} > 0]$$

This particular way of analyzing the conductivity measurements leads to a simple calculation which does not require a too high computing effort.

Preferably, the method further includes starting to heat the washing liquor when the condition of substantial invariability of the conductivity measurements is reached or the upper time limit has been exceeded.

This advantageously leads to a tuning between the detergent dissolution and the heating of the washing liquor so as to link the heater ignition to the real dissolution level of the detergent, thereby assuring that the action of the detergent enzymatic and bleaching components is maxed out.

Preferably, the laundry washing appliance is a washing machine or a washer-dryer. A second aspect of the present invention relates to a laundry washing appliance comprising a washing chamber apt to receive a washing liquor used to wash laundry loaded into the washing chamber and a conductivity sensor apt to perform conductivity measurements of the washing liquor present in the washing chamber or recirculating in a recirculating circuit connected to the washing chamber, characterized in that the conductivity sensor is connected to processing and control means for the implementation of the method for operating a laundry washing appliance as described above.

BRIEF DESCRIPTION OF THE DRAWINGS

With reference to the attached drawings, further features and advantages of the present invention will be shown by means of the following detailed description of some of its preferred embodiments. According to the above description, the several features of each embodiment can be unrestrictedly and independently combined with each other in order to achieve the advantages specifically deriving from a certain combination of the same.

In the said drawings.

DETAILED DESCRIPTION OF EXAMPLE EMBODIMENTS

In the following description, the discussion of the figures will be made by means of reference signs which will be the same for constructional elements having the same function.

Figure 1:
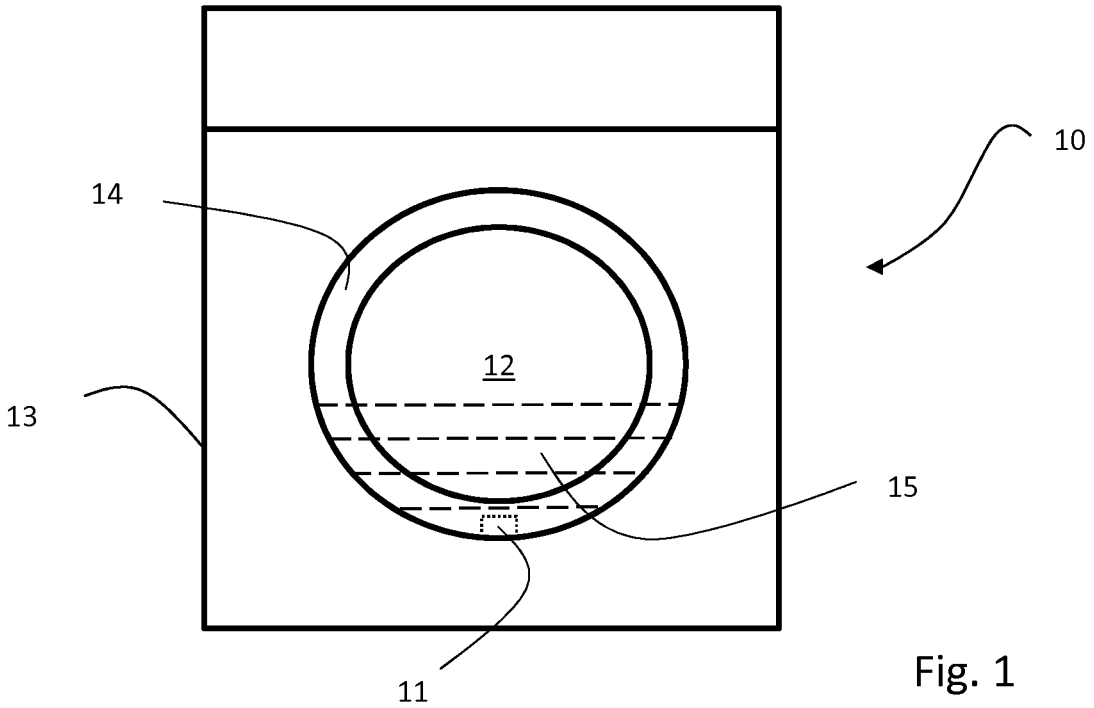
FIG. 1 is a schematic view of a laundry washing appliance operating according to the method of an aspect of the invention.

With reference to FIG. 1, a laundry washing appliance operating according to the method of the invention is globally indicated with reference number 10.

The washing appliance 10, depicted here as the preferred embodiment, not limiting the scope and applicability of the invention, is a washing machine.

The washing machine 10 includes a washing chamber 12, inside of which laundry is placed before a washing program starts and removed after the washing program has completed.

The washing chamber 12 is preferably contained in a casing 13 having an aperture closed by a door 14 pivotably mounted on the casing 13.

The washing machine 10 further includes a conductivity sensor 11, preferably placed inside the washing chamber 12 or within a recirculating circuit (not shown) of the washing appliance in order to be or come in direct contact with a washing liquor 15 for performing conductivity measurements of the same.

With washing liquor 15, a water-based solution is meant, in which detergent is dissolved and in which the laundry is at least partially immersed or soaked.

The washing liquor 15 is used to wash the laundry loaded into the washing chamber.

The conductivity sensor 11 is connected to a processing and/or control device (not shown in the drawings) which executes the method for operating a washing appliance 100 according to the invention.

In order to operate the washing appliance 10, the user loads the washing chamber 12 with laundry to be washed and inserts (step 110) a detergent of a given type for example into a detergent dispenser, drawer, compartment (not shown in the drawings) or directly into the washing chamber 12.

The user then selects a washing program among a plurality of predefined washing programs which include at least a washing cycle.

At the beginning of a washing phase of the washing cycle, the water inlet is opened and fresh water is introduced 120 into the washing chamber 12 (wetting step).

If the detergent is already present in the washing chamber, the introduction of fresh water 100 directly starts to form the washing liquor 15.

Otherwise, if the detergent is not present at this stage, it is flushed into the washing chamber 12 during the introduction of fresh water (step 120) so as to form the washing liquor 15.

Starting from the beginning of the water introduction (step 120), namely from the beginning of the washing phase, the conductivity of the washing liquor (water and detergent solution) is repeatedly measured (step 130), e.g. by means of the conductivity sensor 11.

While detergent is dissolving, the conductivity measurements $C_1, C_2, C_3 \ldots C_n$ are supposed to increase continuously until all detergent is gone into solution.

When all detergent is dissolved, namely when the highest detergent concentration level is reached, water conductivity will not further increase over time, that is, subsequent conductivity readings will give similar results.

In other words, a steady condition of the conductivity signals or measurements indicates that an almost full dissolution of the detergent into the washing liquor has been achieved.

Figure 2:
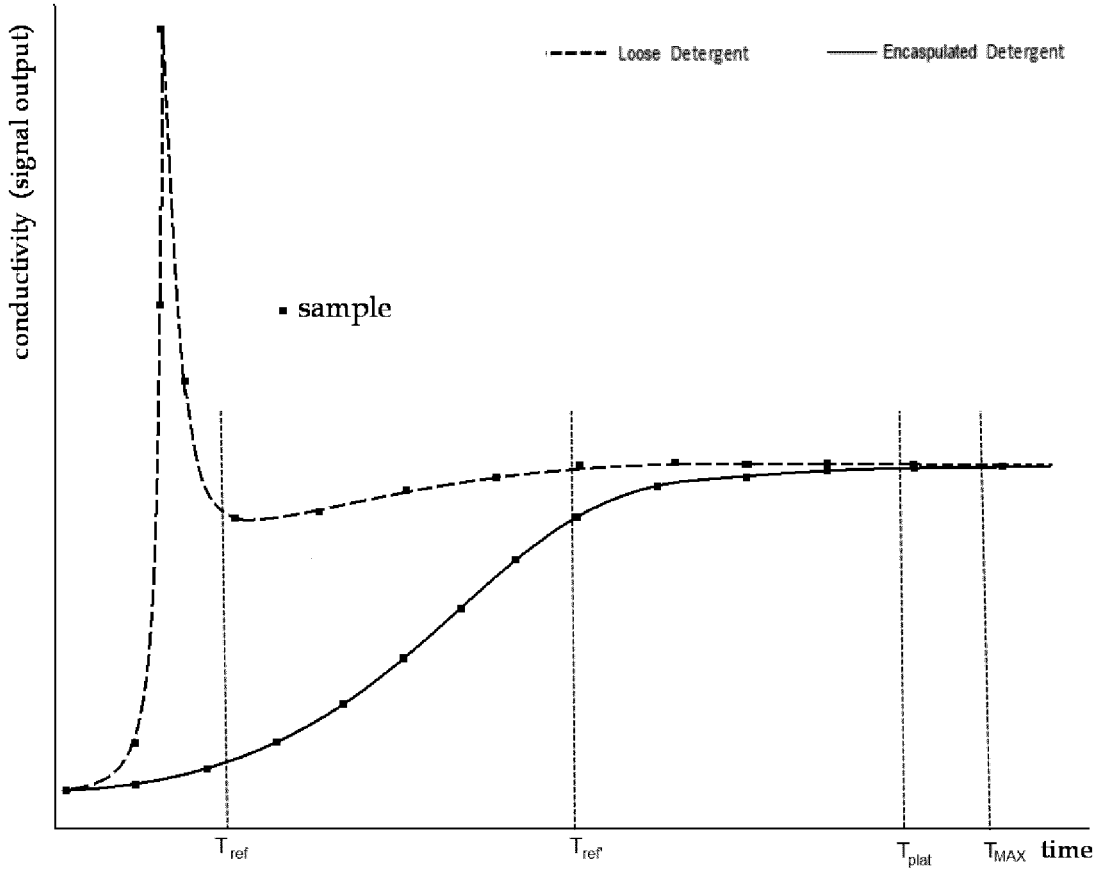
FIG. 2 is a graph schematically showing the conductivity progression of a washing liquor in which detergent in conventional form (curve with peak) or encapsulated (curve without peak) detergent is dissolved.
Figure 3:
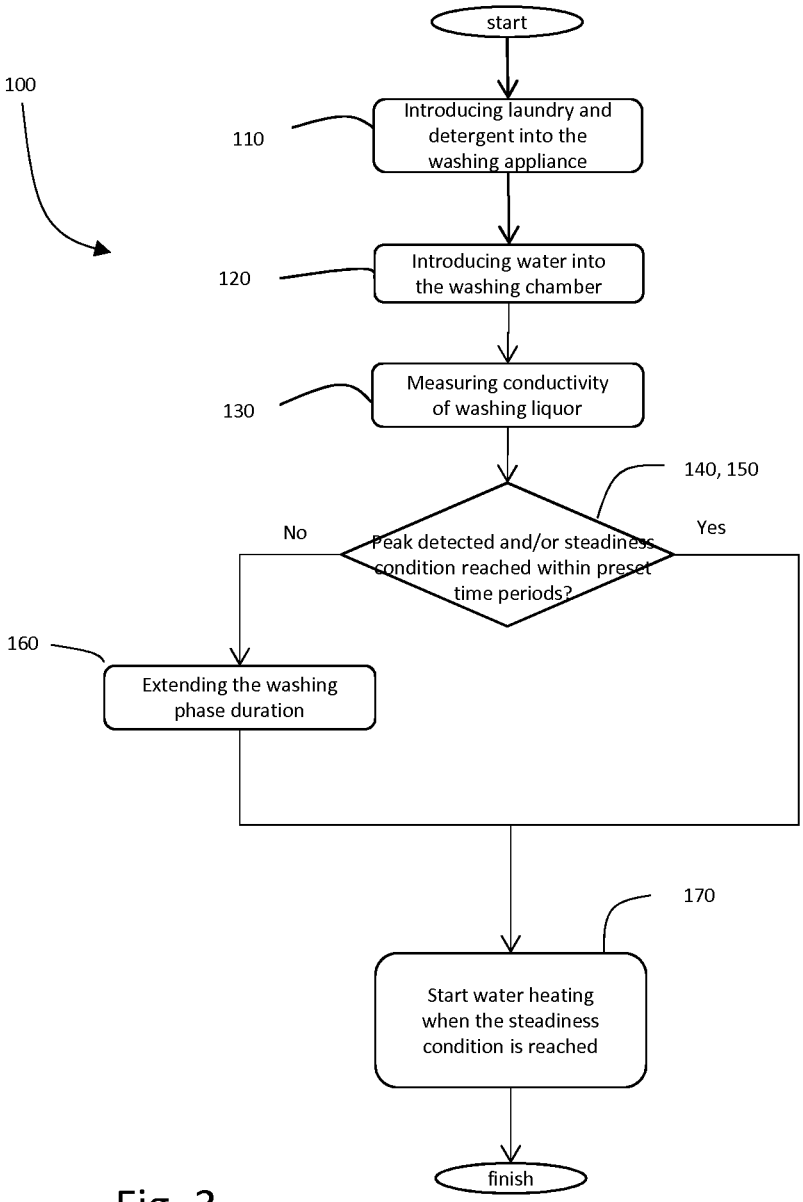
FIG. 3 is a flowchart of the method according to an aspect of the invention.

By way of a non-limiting example, FIG. 2 schematically plots typical trends of conductivity over time after the dissolution of respectively encapsulated detergent and detergent in conventional form (namely loose) begins.

In case of encapsulated detergent, the signal initially grows (up to point ($C_{10}$, $T_{10}$)), then a steady condition is reached where the conductivity values substantially do not vary, also called "plateau".

In case of detergent in conventional form or loose, the related curve shows a peak substantially at the beginning of the water introduction and reaches the steadiness condition (plateau) more rapidly than the curve relating to encapsulated detergent. In order to determine if loose or encapsulated detergent is used, a step 130 of collecting conductivity measurements $C_1, \ldots, C_n$ is performed.

The conductivity measurements are preferably repeated at given time intervals (e.g. equal to 5 s).

The set of collected conductivity measurements $C_1, \ldots, C_n$ is analyzed in order to detect if it is relative to the dissolution of loose detergent or encapsulated detergent.

According to a first preferred embodiment of the present invention, the set of collected conductivity measurements $C_1, \ldots, C_n$ of the water liquor 15 is analyzed in order to detect (step 140) if, at the beginning of the washing phase, the related conductivity curve shows a sudden and high increase.

In other words, the set of conductivity measurements $C_1, \ldots, C_n$ are analyzed in order to determine if the related curve shows a peak.

By way of an non limiting example, the detection (step 140) of the peak is done by comparing relative variations of the same according to the following formula:

$$\sum_{k=0}^{n} |c_{i-k} - c_{i-k-1}| > [\text{Threshold} > 0]$$

with m and a threshold to be defined based on experimental data.

If no sudden increase or peak of the water liquor conductivity is detected after a first preset time period $T_{ref}$, preferably comprised between 30 sec and 3 min, and more preferably comprised between 30 sec and 1 min, after the washing phase has begun, the detergent introduced into the washing chamber is likely to be encapsulated.

Thus, according to the invention, the predefined duration of the washing phase is extended (step 160).

In alternative or in addition to the detection of the peak, the set of collected conductivity measurements $C_1, \ldots, C_n$ is analyzed in order to determine (step 150) if a condition of substantial invariability of the conductivity measurements $C_1, \ldots, C_n$ is reached.

According to the invention, if the condition of substantial invariability has still not been reached after a second preset time period $T_{ref}$, from the beginning of the washing phase, the detergent introduced into the washing chamber is likely to be encapsulated.

Also in this case, according to the invention, the predefined duration of the washing phase is extended (step 160).

Preferably, the second preset time period $T_{ref}$, is comprised between 3 min and 20 min, more preferably between 5 min and 18 min and even more preferably between 10 min and 15 min.

By way of an non limiting example, the analysis of the set of collected conductivity values $C_1, \ldots, C_n$ is done by comparing relative variations of the same according to the following formula:

$$\sum_{k=0}^{m} |c_{n-k} - c_{n-k-1}| < [\text{Threshold} > 0]$$

with m and a threshold to be defined based on experimental data.

This formula takes into account m subsequent conductivity readings, namely a variation over a time period is considered.

The number m of subsequent measurements to be taken into consideration for the evaluation of the steady condition is preferably higher than two.

It is clear that the longer the considered time period is, the greater is the accuracy of the steadiness detection and the lower is the possibility to fail.

If the sum of the relative variations keeps staying below the given threshold, then the conductivity is considered to be steady, namely the detergent is almost fully dissolved in the washing liquor.

The extension step 160 of the washing phase duration can be performed according to two alternative preferred embodiments.

According to a first preferred embodiment, the predefined duration of the washing phase is extended (step 160) by a first fixed extension time $T_{ext}$.

The implementation of this first embodiment is quite simple and easy to be achieved since no dynamic calculation of the time extension has to be performed: it is predefined a priori. Thus, as soon as one of the conditions identifying an encapsulated detergent is met, the method provides for a fixed time extension without requiring further calculations.

According to a second preferred embodiment, the predefined duration of the washing phase is extended by an extension time $T_{ext}$ dependent on the time $T_{plat}$ required to reach the condition of substantial invariability of the conductivity measurements $C_1, \ldots, C_n$.

In order to determine the amount of time $T_{plat}$ required to get to a condition of substantial invariability of the conductivity measurements $C_1, \ldots, C_n$, the collection of conductivity measurements $C_1, \ldots, C_n$ is carried on and the set of collected measured conductivity values $C_1, \ldots, C_n$ is analyzed to understand if an almost steady condition of the same has been reached.

When the steadiness condition is reached, it is measured how long it has taken to reach the said steadiness condition.

In detail, the extension time to add to the washing phase duration is preferably calculated as follows.

If the amount of time $T_{plat}$ required to reach the condition of detergent full dissolution is lower than a fixed time value $T_0$ which denotes a rapid dissolution of the encapsulated detergent, the washing phase is not extended at all.

This avoids introducing an extension of time where it is actually not required. If the amount of time $T_{plat}$ required to reach the condition of detergent full dissolution is greater than or equal to the fixed time value $T_0$, the predefined duration of the washing phase is extended (step 160) by an extension time $T_{ext}$ that could be, by way of a mere example, equal to the difference ($T_{plat}$-$T_0$) between the time $T_{plat}$ for reaching the condition of detergent full dissolution and the fixed time value $T_0$.

Preferably, the fixed time value $T_0$ is variable and depends on the wash program selected by the user. The fixed time value $T_0$ is usually lower for short wash programs and/or wash programs using cold water (e.g. lower than 40° C.), compared to long wash programs and/or using warm/hot water (e.g. equal to or higher than 40° C.).

The analysis step 150 of the set of collected conductivity $C_1, \ldots, C_n$ is repeated until either the steadiness condition is reached or an upper time limit $T_{MAX}$ has been exceeded.

If the steadiness condition has not been reached after the upper time limit $T_{MAX}$ has expired, the predefined duration of the washing phase is extended (step 160) by a second fixed extension time $T_{ext''}$, which is possibly different than the first fixed extension time $T_{ext'}$. This avoids the washing phase to last excessively in case the signal steadiness detection fails.

Preferably, the heating of the washing liquor is started (step 170) only after the result of the analysis steps indicates that a condition of detergent full dissolution is reached or the upper time limit $T_{MAX}$ has expired.

Preferably, the analysis step 150 is done stepwise, namely if after a first analysis step 150 the steadiness condition has not been reached, further conductivity measurements are preformed and the analysis step 150 is repeated on the newly collected set of conductivity values.

Preferably, the subsequent analysis step 150 is delayed of a preset time interval $T_d$ with respect to the previous analysis step 150, in order to reduce the total number of analysis steps necessary before complete dissolution is reached.

If after the first preset time period $T_{ref'}$, a sudden increase or peak of the water liquor conductivity is detected, and/or if after the second preset time period $T_{ref''}$, the condition of detergent full dissolution has been already reached, the detergent introduced into the washing chamber is likely to be in conventional form, namely loose. In this case, the detergent dissolution is usually very rapid. Thus, there is no need to extend the duration of the washing phase.

However, also in this case, the heating of the washing liquor is preferably started (step 170) only after the result of the analysis steps indicates that a condition of detergent full dissolution is reached.

From the above description the features of the method for operating a laundry washing appliance according to the present invention so as its related advantages are clear.

Further alternatives of the above described embodiment are still possible without departing from the teachings of the invention.

It is finally clear that the so designed method for operating a laundry washing appliance and related laundry washing appliance can undergo many changes and variations all within the invention; furthermore all the details of the laundry washing appliance can be replaced with technically equivalent elements. In practice, all the used materials and the dimensions can be varied according to the technical requirements without departing from the invention.

The invention claimed is:

1. A method for operating a laundry washing appliance comprising a washing chamber to wash goods according to a wash program selected by a user including at least a washing cycle, said method including:

adding a detergent to a washing liquor within the washing chamber during a washing phase of the washing cycle, the washing phase having a predefined duration;

performing a plurality of measurements of the conductivity of the washing liquor in order to collect a set of conductivity measurements defining a conductivity curve;

analyzing the set of conductivity measurements in order to determine when a steady condition of the conductivity measurements is reached and/or detect when the related conductivity curve shows a peak;

extending the predefined duration of the washing phase, when during a first preset time period starting from the beginning of the washing phase, it is determined that no conductivity increase or peak in the conductivity curve is detected; and extending the predefined duration of the washing phase, when after a second preset time period starting from the beginning of the washing phase and ending after the first preset time period, it is determined that the steady condition of the conductivity measurements has not been reached.

2. The method according to claim 1, wherein the predefined duration of the washing phase is extended by a first fixed extension time.

3. The method according to claim 1, wherein the predefined duration of the washing phase is extended by an extension time dependent on a time required to reach said steady condition of the conductivity measurements.

4. The method according to claim 2, wherein:

when the amount of time required to reach the steady condition of the conductivity measurements is lower than a fixed time value, the predefined duration of the washing phase is extended by an extension time equal to zero; and when the amount of time required to reach the steady condition of the conductivity measurements is greater than or equal to a fixed time value, the predefined duration of the washing phase is extended by an extension time equal to the difference between the time for reaching the steady condition of the conductivity measurements and the fixed time value.

5. The method according to claim 4, wherein the fixed time value is variable dependent on the wash program selected by the user.

6. The method according to claim 1, wherein said first preset time period is less than or equal to said second preset time period.

7. The method according to claim 1, wherein said first preset time period is comprised between 30 sec and 5 min.

8. The method according to claim 1, wherein said second preset time period is comprised between 3 min and 20 min.

9. The method according to claim 1, further comprising determining the amount of time required to get to said steady condition of the conductivity measurements.

10. The method according to claim 9, wherein said step of determining the amount of time required to get to said steady condition of the conductivity measurements comprises:

carrying on with performing a plurality of measurements of the conductivity of the washing liquor and analyzing the set of conductivity measurements in order to determine when the steady condition of the conductivity measurements has been reached, until said steady condition of the conductivity measurements is reached.

11. The method according to claim 1, wherein the step of analyzing the set of conductivity measurements in order to determine when the steady condition measurements is reached comprises:

comparing relative variations of successive conductivity measurements according to the formula:

$$\sum_{k=0}^{m} |c_{n-k} - c_{n-k-1}| < [\text{Threshold} > 0]$$

identifying the steady condition of the conductivity measurements when the sum of the relative variations keeps staying below a threshold, wherein $C_n$ is the nth conductivity measurement, and n, m and k are integer values.

12. The method according to claim 11, wherein the number of successive conductivity measurements to be taken into consideration for the evaluation of the steady condition of the conductivity measurements is equal to or greater than two.

13. The method according to claim 9, wherein the step of determining the amount of time required to get to the steady condition of the conductivity measurements further includes:

measuring the amount of time passed from the start of the washing phase to the point of time the steady condition of the conductivity measurements has been reached.

14. The method according to claim 9, wherein the step of determining the amount of time required to get to the steady condition of the conductivity measurements is repeated until either the steady condition of the conductivity measurements is reached or an upper time limit has been exceeded.

15. The method according to claim 14, wherein when the steady condition of the conductivity measurements is not reached after the upper time limit has expired, the predefined duration of the washing phase is extended by a second fixed extension time.

16. The method according to claim 1, wherein extending the predefined duration of the washing phase comprises extending the duration of a tumbling step of the washing phase.

17. The method according to claim 1, wherein the detection when the conductivity curve shows a peak includes comparing relative variations of successive conductivity measurements according to the formula:

$$\sum_{k=0}^{n} |c_{i-k} - c_{i-k-1}| > [\text{Threshold} > 0]$$

wherein $C_i$ is the ith conductivity measurement, and i, n and k are integer values.

18. The method according to claim 14, wherein it further includes:

starting to heat the washing liquor when the steady condition of the conductivity measurements is reached or the upper time limit has been exceeded.

19. The method according to claim 1, wherein said laundry washing appliance is a washing machine or a washer-dryer.

20. A laundry washing appliance comprising a washing chamber apt to receive a washing liquor used to wash laundry loaded into the washing chamber and a conductivity sensor apt to perform conductivity measurements of the washing liquor present in the washing chamber or recirculating in a recirculating circuit connected to the washing chamber, wherein the conductivity sensor is connected to processing and control means for the implementation of the method for operating a laundry washing appliance according to claim 1.

* * * * *